US008474464B2

(12) United States Patent
Smith

(10) Patent No.: US 8,474,464 B2
(45) Date of Patent: Jul. 2, 2013

(54) METHOD AND MATERIAL FOR NAIL MANICURING

(76) Inventor: Jacqueline A. Smith, Sycamore, IL (US)

( * ) Notice: Subject to any disclaimer, the term of this patent is extended or adjusted under 35 U.S.C. 154(b) by 543 days.

(21) Appl. No.: 12/618,252

(22) Filed: Nov. 13, 2009

(65) Prior Publication Data

US 2010/0116284 A1 May 13, 2010

Related U.S. Application Data

(60) Provisional application No. 61/114,278, filed on Nov. 13, 2008.

(51) Int. Cl.
*A45D 29/00* (2006.01)

(52) U.S. Cl.
USPC ..... 132/200; 132/73

(58) Field of Classification Search
USPC ..... 132/73, 200, 285; 427/259, 260, 427/264, 272, 282; 428/41.5–42.3
See application file for complete search history.

(56) References Cited

U.S. PATENT DOCUMENTS

| | | | | | |
|---|---|---|---|---|---|
| 2,180,519 | A | * | 11/1939 | Hamilton et al. | 132/285 |
| 2,449,070 | A | | 9/1948 | Peter | |
| 2,764,168 | A | | 9/1956 | Benno | |
| 3,840,113 | A | * | 10/1974 | Bartleson | 206/575 |
| 3,928,113 | A | | 12/1975 | Rosenberg et al. | |
| 4,126,144 | A | | 11/1978 | Duarte | |
| 4,370,941 | A | * | 2/1983 | Belton | 118/13 |
| 4,675,023 | A | * | 6/1987 | Hyink | 8/447 |
| 4,767,648 | A | * | 8/1988 | Hokama et al. | 428/15 |
| 4,960,587 | A | | 10/1990 | Rucker | |
| 5,133,369 | A | * | 7/1992 | Billings | 132/200 |
| 5,150,726 | A | * | 9/1992 | Rucker | 132/285 |
| 5,400,257 | A | * | 3/1995 | Krinsky et al. | 700/133 |
| 5,427,121 | A | * | 6/1995 | Polito | 132/200 |
| 5,698,264 | A | * | 12/1997 | Gumbert | 427/282 |
| 5,778,901 | A | * | 7/1998 | Abrahamian | 132/74.5 |
| 5,824,293 | A | * | 10/1998 | Zajac | 424/61 |
| 5,890,495 | A | * | 4/1999 | Cain | 132/73 |
| 5,924,428 | A | * | 7/1999 | Song | 132/285 |
| 5,996,591 | A | * | 12/1999 | Landa et al. | 132/200 |
| 6,213,131 | B1 | * | 4/2001 | Vien et al. | 132/285 |
| 6,663,143 | B2 | * | 12/2003 | Zirker | 283/81 |

(Continued)

OTHER PUBLICATIONS

Art Tips Quick Tips to Help with your Projects, Jan. 2, 2011, http://www.jerrysartarama.com/community/art-tips.html, pp. 1-12.*

(Continued)

*Primary Examiner* — Robyn Doan
*Assistant Examiner* — Tatiana Nobrega
(74) *Attorney, Agent, or Firm* — Erickson Law Group, PC

(57) ABSTRACT

A nail manicure method and kit, comprising applying a protective coating to portions of the surface of a finger or toe nail where the application of nail polish is not desired, optionally manipulating the protective coating into a desired shape, and applying nail polish to regions not covered by the protective coating. Once the nail polish has at least partially dried, the protective coating is removed to reveal a surface of a nail with well defined regions of nail polish and the region covered by the protective coating. The protective coating is used to generate various customized designs by the user. The protective coating is manipulated by pushing or removing portions of the protective coating using a shaping object. The protective coating is removed by peeling or rubbing. The protective coating comprises rubber and water.

19 Claims, 2 Drawing Sheets

U.S. PATENT DOCUMENTS

| | | | | |
|---|---|---|---|---|
| 7,134,440 | B1 * | 11/2006 | Dombeck | 132/285 |
| 2003/0089378 | A1 * | 5/2003 | Chu | 132/200 |
| 2006/0037624 | A1 * | 2/2006 | Ilekti | 132/73 |
| 2006/0207624 | A1 * | 9/2006 | Klein | 132/200 |
| 2007/0277331 | A1 | 12/2007 | Goldstein et al. | |
| 2008/0075839 | A1 * | 3/2008 | Haubrich et al. | 427/66 |
| 2008/0092914 | A1 * | 4/2008 | Baxter | 132/200 |
| 2008/0138520 | A1 * | 6/2008 | Chu | 427/265 |
| 2009/0074968 | A1 * | 3/2009 | Dunlop et al. | 427/259 |
| 2009/0120453 | A1 * | 5/2009 | Tran | 132/285 |
| 2010/0158836 | A1 * | 6/2010 | Nelson et al. | 424/61 |
| 2010/0313904 | A1 * | 12/2010 | Garinger | 132/200 |

OTHER PUBLICATIONS

Art Made Easy!, Using Liquid Frisket, http://www.art-made-easy.com/liquid-frisket.html, Nov. 23, 2007 pp. 1-2.*

Cedar Canyon Textiles, Liquid Frisket through a Stencil ~ Playing with Stencils 1, http://cedarcanyontextiles.com/playing -with-stencils-a-series-by-susan-stein/, Nov. 23, 2009, pp. 1-6.*

ARTtalk, Airbrush Liquid Frisket techniques, www.arttalk.com/archives/vol-10/artv1006-7.htm, Oct. 19, 2006, pp. 1-2.*

WetCanvas!, Using Masking Fluid (Liquid Frisket) by George Simmons, http://wetcanvas.com/ArtSchool/Watercolors/SimmonsTips/usingfrisket.html, Oct. 12, 1999, p. 1.*

* cited by examiner

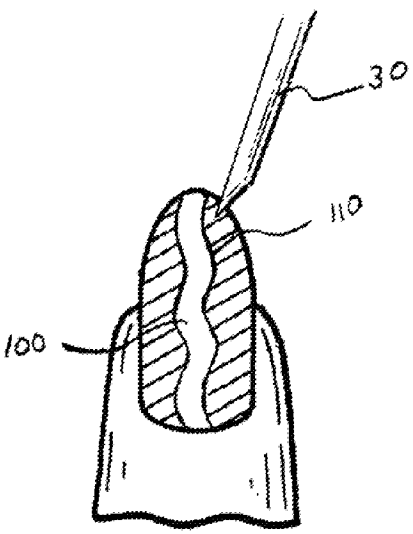
Figure 5
Figure 7
Figure 4
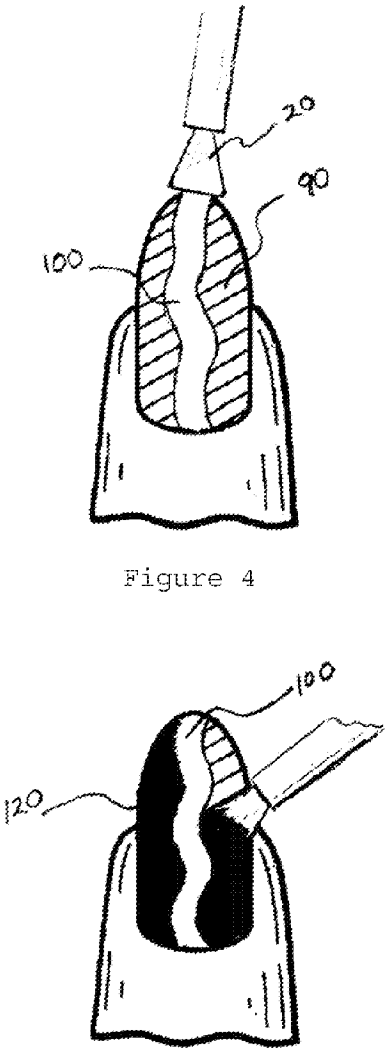
Figure 6

METHOD AND MATERIAL FOR NAIL MANICURING

This application claims the benefit of U.S. Provisional Application 61/114,278 filed on Nov. 13, 2008.

FIELD OF THE INVENTION

This invention relates in general to nail manicure methods, and more particularly to generating designs on the surface of the nail.

BACKGROUND OF THE INVENTION

When receiving a manicure, nail polish is usually applied to the surface of the nail. Various compositions of nail polish have been disclosed in the prior art, each with various desirable features such as quick drying, ease of application or removal, or durability, resistance to breaking or chipping. U.S. Pat. Nos. 2,764,168, 3,982,113, and 4,126,144 disclose nail polish compositions that are easy to remove. Other compositions and devices have been developed to assist in better application of nail polish for a better overall manicure, such as the use of a top coat, base coat, or protective coatings to prevent nail polish from reaching the cuticle area and skin areas proximate to the nail. U.S. Pat. Nos. 4,960,587 and 5,150,726 disclose an adhesive mask for covering the cuticle to prevent nail polish from being accidentally applied to the cuticle. U.S. Pat. No. 2,339,070 and U.S. Patent Application Publication 2007/0277331 discloses coating compositions for protecting the cuticle from unwanted nail polish. Often, it is desirable to use one or more colors to generate a design on the surface of the nail. U.S. Pat. Nos. 3,598,685, 3,885,578, 5,133,369 disclose methods and apparatus for generating designs on the surface of the nail.

Application of nail coating is normally accomplished with a brush or similar application. Application of nail designs is also frequently accomplished through the use of brushes with various sizes to achieved desired design effects, through the use of design stencils or adhesive ornamentation, or through the use of pen-tipped devices that dispense nail color. It is desirable in many circumstances to have designs with precise, well defined edges, however, precise, well defined edges are often difficult to generate when applying nail polish, even with a stencil, as often the removal of the stencil prior to complete drying of the nail polish can leave ill defined edges. In addition to the difficulties of painting a precise design on the surface of a fingernail, generating a freehand design has its limitations because errors are difficult to correct. Removing nail polish and reapplying nail polish can be tedious and time consuming.

It is often difficult to perform a manicure on oneself, and even more challenging to apply designs to the surface of a nail by oneself. Frequent visits to a manicurist can become costly, and services obtained may not always be satisfactory, as the quality of the manicure and/or designs on the nail are subject to the experience and artistic capabilities of the manicurist.

The present inventor has recognized that known prior art methods described, and others, for applying designs to the nail surface have been disadvantageous for various reasons. The present inventor has recognized the need for a method of applying designs to the surface of the nail that is easy to perform on oneself, and minimizes the time consuming errors of correcting misshapen figures on the surface of the nail. The present inventor has recognized the need for a method of applying designs to the surface of the nail which allows the user to adjust the design until the correct configuration has been obtained. The present inventor has recognized the need for a method of applying precise designs to the surface of the nail which are not limited by the design templates of available stencils, or limited to designs available on artificial nails, or to artificial nails for a "French manicure"—manicures designed to resemble a natural nail, and are characterized by natural pink base nails with white tips—comprising French tips that are often unnatural looking and do not conform to the users natural nail tips.

SUMMARY OF THE INVENTION

The present invention provides a method and a kit for creating designs on the surface of a finger or toenail that minimizes the disadvantages of described above.

The present invention provides a method of creating designs on the surface of a finger nail by providing a pliable and removable protective coating to prevent nail polish from being applied to particular areas of the nail surface. The protective coating is fast drying, easily removable, and easily manipulated into desired shapes.

The present invention provides a composition that provides a quick drying, pliable, easily manipulated, and easily removable protective coating to prevent the application of nail polish to the surface of a nail.

Numerous other advantages and features of the present invention will be become readily apparent from the following detailed description of the invention and the embodiments thereof, from the claims and from the accompanying drawings.

BRIEF DESCRIPTION OF THE DRAWINGS

FIG. 4 illustrates the application of the protective coating on to the surface of a painted nail in accordance with certain steps in one embodiment of a nail design method.

FIG. 5 illustrates the shaping of the protective coating on the surface of a painted nail.

FIG. 6 illustrates the painting of the nail around the protective coating.

FIG. 7 illustrates the removal of the coating.

DETAILED DESCRIPTION OF THE PREFERRED EMBODIMENTS

Figure 1:
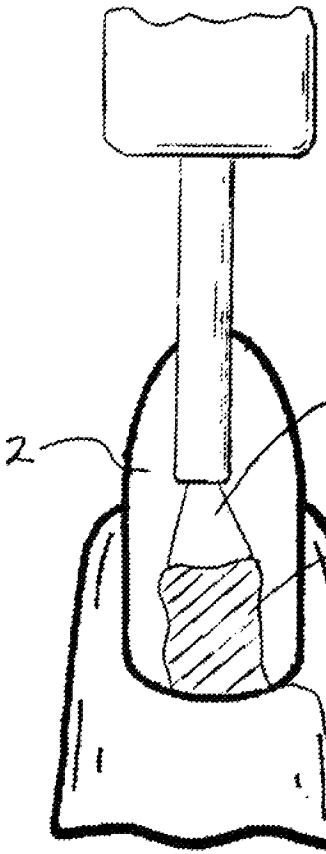
FIG. 1 illustrates the application of the protective coating on to the surface of a nail in accordance with certain steps in one embodiment of a nail design method

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Figure 2:
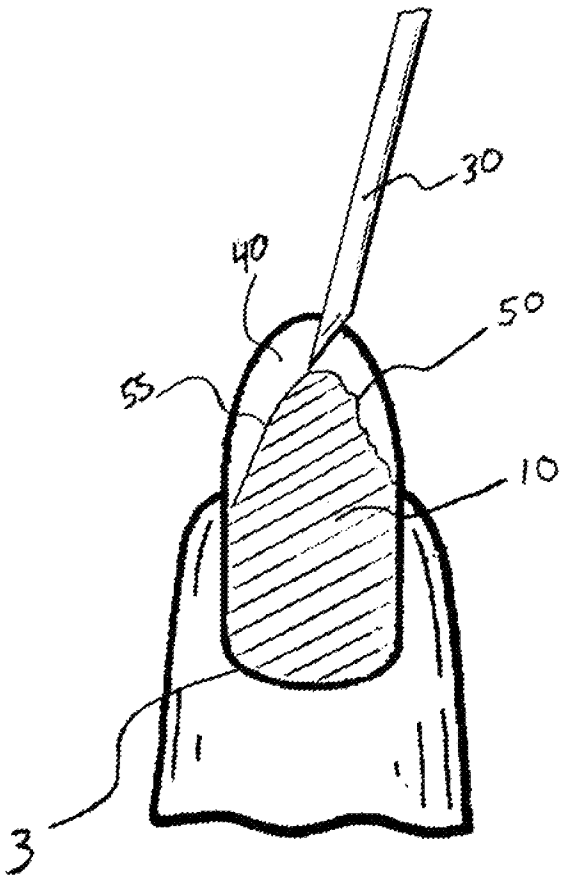
FIG. 2 illustrates the shaping of the protective coating on the surface of a nail.
Figure 3:
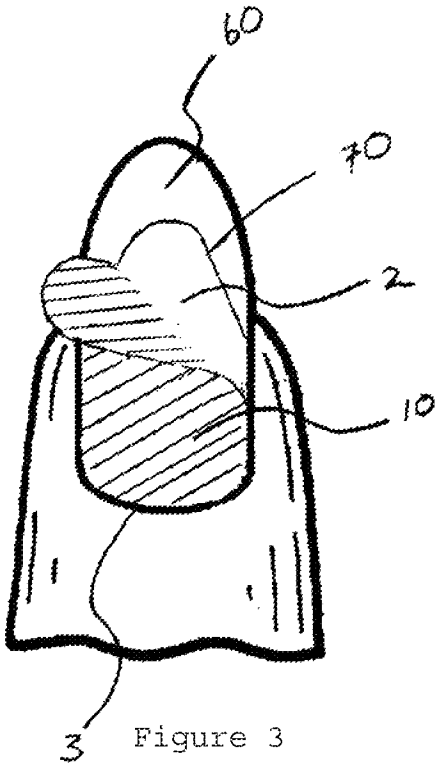
FIG. 3 illustrates the removal of the protective coating on the surface of a nail.

In one embodiment, which can be used to create a French manicure effect, the protective coating 10 is applied to the surface of a fingernail 2 using a brush 20, as illustrated in FIG. 1. The protective coating is applied to portions of the fingernail where one does not desire the application of nail polish. In the case of a French manicure, the area of the nail from the cuticle 3 up to the region where the nail grows out from the nail bed (not shown), or beyond, can be covered with the protective coating 10. The tip 40 of the fingernail where the nail polish for the French manicure tip is to be applied is left uncovered by the protective coating 10. Once the protective coating has at least partially dried so that it is capable of being manipulated or shaped, the user can use a shaping object, such as their fingernails, a cuticle stick 30, or any object that can be used to shape the protective coating, to generate the desired shape of the curved edge for applying the tip color of the nail in a French manicure. FIG. 2 illustrates the shaping of the protective coating to generate the curved edge for the lower boundary of the French manicure tip. The edge 50 prior to shaping maybe be uneven, thus the edge can be shaped using a cuticle stick 30 as illustrated to generate a smoothed edge 55. Once the desired curved edge of the lower French tip boundary has been defined, the user can apply nail polish to the tip 40 of the fingernail. Once the nail polish 60 in the tip of the French manicure has at least partially set, the protective coating 10 is removed as illustrated in FIG. 3, to reveal a nail surface with a painted French manicure tip comprising a precise bottom edge 70.

Additional layers of nail polish, a top coat, or other protective layers can be applied to the nail surface with the painted French manicure tip. Given the present disclosure, it is possible to apply a base coat, a priming layer, or other possible first layers as known to one skilled in the art, to the surface of the nail prior to, or after the application and removal of the protective coat. For example, the protective coat can be applied on top of the base coat, or the protective layer can be applied prior to the application of a base coat adjacent to the protective layer. The base coat can also be applied to the nail surface 2 once the protective coating 10 has been removed.

Given the present disclosure, the ability to provide customized French manicure tip shapes provides many advantageous over prior art French manicure kits. The ability to shape the protective coating into a desired shaped allows the user more freedom in designing their French manicure, and does not limit the user to shapes provided by traditional adhesive coatings, or other pre-set templates such as artificial French manicure nails comprising French tips that are often unnatural looking and do not conform to the users natural nail tips. In one embodiment, the user is able to manipulate the coating to provide a French manicure tip in alignment with their actual nail if desired. The user is also granted more freedom to design their French manicure tips into creative variations such as having a waved bottom edge of the French manicure tip (not shown). The pliable nature of the protective coating allows for the user manipulate the coating into the desired shaped first without the associated worries of applying nail polish freehand, as accurate and complete removal of unwanted nail polish is time consuming.

In another embodiment, the protective coating is used to generate designs on the surface of an nail 90 with an existing nail color. As illustrated in FIG. 4, protective coating 100 is applied in an amount and in a general shape corresponding to the shape of the final design. The coating is applied with a brush 20, onto a surface of a nail 90 with an existing coat of color. Once the protective coating 100 has at least partially set, a shaping object, such as a cuticle stick 30, is used to shape the protective coating into a desired shaped by manipulating edges 110, as illustrated in FIG. 5. Once the protective coating is manipulated into the desired shaped, a second nail polish layer 120 is applied to regions of the nail not covered by the protective coating, as illustrated in FIG. 6. Once the second nail polish layer 120 is applied and has at least partially set, the protective coating 100 is removed to reveal a design pattern of the existing nail color 90. Such treatment of the nails results in neat and attractive colored regions on the nails with shapes of sharply defined edges to meet the desires of the user. In other embodiments, nail polish layer 120 can be applied within an area defined by the protective coating, rather than to an area surrounding the protective coating as illustrated in FIG. 6.

In another embodiment, the protective coating can be used in conjunction with templates, such as a stencil, for users who prefer not to apply the protective coating onto the nail surface without a guiding mechanism. In this embodiment, the stencil is overlaid onto the surface of a nail which may or may not have a pre-existing nail color. A desired stencil shape is chosen, and overlaid onto the surface of the nail. A layer of protective coating is applied to region defined by the stencil. Once the shape of the protective coating has been generated, the user may proceed as illustrated in FIG. 6 and FIG. 7.

The protective coating can be provided as part of a kit for performing manicures, wherein the kit can contain the protective coating along with other items such as a shaping object, nail polish, and stencils.

The shaping or manipulation of the protective coating can be accomplished by pushing in portions of the protective coating to generate the desired edges of the shape, or by removing uneven edges, for example, by peeling off or causing to peel off, the portions that create the uneven edges, using shaping objects. Removal of uneven edges can also be accomplished by pushing the non-desirable edge portions of the protective coating away from the rest of the protective coating, thus separating it from the protective coating. It is sometimes preferable to pre-define, or outline the area desired to be removed from the protective coating by pressing down on the protective coating, while tracing out the desired area to be removed using the tip of a shaping object, such that the actual removal of the protective coating layer is facilitated.

Objects than can be used to shape or manipulate the protective coating include cuticle sticks, including rubber tipped cuticle sticks, tweezers, metal spatulas, fingernails, tip of a nail file, or any other object capable of manipulating the protective coating into a desired shape. The shaping object is preferably one that will not scratch the surface of the layer beneath the protective coating.

Protective coating can be applied using various devices, including, but not limited to brushes, dispensers, containers, roll-ons, tubes, tubules, and other devices as disclosed in U.S. Patent Application 2007/0277331.

The protective coating comprises rubber and water. Additives such as pH stabilizers, anti-microbial agents, thickeners, coloring agents, curing agents, and scenting agents are optionally added to the protective coating. The rubber can be natural rubber, synthetic rubber, or a combination thereof. Rubber can be in liquid form, solid, or in a cream like consistency. Rubber is combined in suitable proportions with water, if needed, to generate a product with the desired consistency. Typical formulations include 20% to 40% latex, and 80% to 60% water. The rubber can also be dissolved in volatile solvents to enhance the drying process. Latex, sold in liquid forms such as that sold by Graftobian Make-Up or Yulex® Natural Rubber Emulsions, sold by Yulex Corporation company can be used to formulate a protective coating. PH stabilizers such as ammonium hydroxide, potassium hydroxide, triethanolamine, and others types of stabilizing agents known to those skilled in the art can be added to the latex to preserve the pH of the product within a suitable range for cosmetic applications. Thickeners, such as those made from soy, rice, starch, or a combination thereof, and others, can also be used to achieve the desired consistency of the final product. Curing agents such as tetramethylthiuram disulfide, and others can be used to accelerate the curing time.

The protecting coating is preferably quick to dry and able to provide a smooth application. The protective coating is of a consistency such that the shape of the coating as applied will result in the shape of the coating once it is dried so as to minimize the ability of the protective coating to spread out or run, and to maximize the user's control over the application. The consistency of the protective coating is suitable and commensurate with the type of device used to dispense the protective coating. The protective coating is easily removable, preferably by rubbing or peeling, but other methods of removable can be used.

From the foregoing, it will be observed that numerous variations and modifications may be effected without departing from the spirit and scope of the invention. It is to be understood that no limitation with respect to the specific apparatus illustrated herein is intended or should be inferred.

All references, including publications, patent applications, and patents, cited herein are hereby incorporated by reference to the same extent as if each reference were individually and specifically indicated to be incorporated by reference and were set forth in its entirety herein.

The invention claimed is:

1. A method of creating designs on the surface of a nail comprising:

applying a protective coating over at least a first portion of a surface of the nail, where the protective coating comprises rubber;

allowing the protective coating to at least partially set;

applying a nail polish over at least a second portion of the surface of the nail, the second portion is adjacent to the first portion; and removing the protective coating from the nail before the nail polish is completely dry to reveal the first portion of the nail not covered by said nail polish.

2. The method of claim 1, wherein the step of applying the protective coating comprises using a brush.

3. The method of claim 1, wherein the step of applying the protective coating comprises dispensing the protective coating from a narrow opening.

4. The method of claim 1, wherein the step of applying the protective coating comprises using a template.

5. The method of claim 1, further comprising a step of manipulating the protective coating into a desired shape.

6. The method of claim 5, wherein the step of manipulating the protective coating into a desired shape is accomplished using a shaping object.

7. The method of claim 6, wherein the shaping object is a fingernail or a sharp tipped stick.

8. The method of claim 5, wherein the step of manipulating the protective coating into a desired shape comprises moving edges or a perimeter of the protective coating to define a desired shape.

9. The method of claim 5, wherein the step of manipulating the protective coating into a desired shape comprises removing portions of the protective coating.

10. The method of claim 5, wherein the step of manipulating the protective coating into a desired shape comprises the step of pushing the protective coating.

11. The method of claim 10, wherein the step of pushing the protective coating is further defined by pushing the edges of the protective coating towards regions containing the protective coating.

12. The method of claim 10, wherein the step of pushing the protective coating is further defined by pushing the edges of the protective coating away from regions containing the protective coating.

13. The method of claim 1, wherein the step of applying a nail polish is further defined in that more than one layer of nail polish is applied.

14. The method of claim 1, wherein the step removing comprises the step of peeling the protective coating from the nail.

15. A method of creating designs on the surface of a nail comprising:

applying a first nail polish to the surface of a nail;

applying a protective coating over one or more portions of the surface of the nail, where the protective coating comprises rubber;

allowing the protective coating to at least partially dry;

applying a second nail polish over exposed portions of the nail; and removing the protective coating by peeling the protective coating from the nail before the nail polish is completely dry to reveal one or more portions of the nail not covered by the second nail polish.

16. The method of claim 15, wherein the protective coating is applied using a template.

17. The method of claim 15, further comprising the step of manipulating the protective coating into a desired shape.

18. The method of claim 17, wherein the step of manipulating the protective coating into a desired shape is accomplished using a shaping object.

19. The method of claim 17, wherein the step of manipulating the protective coating into a desired shape comprises moving portions of the protective coating to define a desired shape.

* * * * *